US008109052B2

(12) United States Patent
Rosende et al.

(10) Patent No.: US 8,109,052 B2
(45) Date of Patent: Feb. 7, 2012

(54) MONOLITHIC FENESTRATION CONSTRUCTION MEMBER AND WALL AND FENESTRATION ASSEMBLY USING THE SAME

(75) Inventors: John Leonard Rosende, Tampa, FL (US); Leonard Rosende, Jr., Tampa, FL (US); Christopher Ryan Rosende, Tampa, FL (US)

(73) Assignee: The Molding Depot, Inc., Tampa, FL (US)

( * ) Notice: Subject to any disclaimer, the term of this patent is extended or adjusted under 35 U.S.C. 154(b) by 202 days.

(21) Appl. No.: 12/469,996

(22) Filed: May 21, 2009

(65) Prior Publication Data

US 2010/0251643 A1 Oct. 7, 2010

(51) Int. Cl.
*E06B 3/00* (2006.01)

(52) U.S. Cl. ..... 52/204.55; 52/204.53; 52/215; 52/656.2

(58) Field of Classification Search ..... 52/204.55, 52/204.53, 204.2, 204.1, 208, 211, 215, 656.2, 52/656.5, 656.6
See application file for complete search history.

(56) References Cited

U.S. PATENT DOCUMENTS

| | | | | |
|---|---|---|---|---|
| 1,965,165 | A * | 7/1934 | Wilson | 52/204.55 |
| 2,187,490 | A * | 1/1940 | Dewey et al. | 52/204.54 |
| 2,326,549 | A * | 8/1943 | Miller | 52/211 |
| 3,214,873 | A * | 11/1965 | Davis | 52/513 |
| 3,340,665 | A * | 9/1967 | Kohl | 52/656.6 |
| 3,768,220 | A * | 10/1973 | Riegelman, Jr. | 52/208 |
| 4,430,831 | A * | 2/1984 | Kemp | 52/204.53 |
| 4,589,624 | A * | 5/1986 | Jones | 249/177 |
| 4,693,043 | A * | 9/1987 | Knapp | 52/211 |
| 5,996,293 | A * | 12/1999 | Anderson et al. | 52/215 |
| 6,745,523 | B2 * | 6/2004 | Petta | 52/213 |
| 6,807,778 | B2 * | 10/2004 | Engebretson | 52/204.59 |
| 7,165,364 | B2 * | 1/2007 | Inelli | 52/208 |
| 8,024,898 | B2 | 9/2011 | Alvarado | |
| 2009/0205272 | A1 * | 8/2009 | Rosende | 52/215 |
| 2009/0266014 | A1 * | 10/2009 | Green | 52/204.55 |
| 2009/0277110 | A1 * | 11/2009 | Cashman | 52/213 |
| 2010/0269433 | A1 * | 10/2010 | Westra | 52/215 |

* cited by examiner

*Primary Examiner* — Brian Glessner
*Assistant Examiner* — Adriana Figueroa
(74) *Attorney, Agent, or Firm* — Maxey Law Offices, PLLC; Stephen Lewellyn

(57) ABSTRACT

A fenestration construction member includes a monolithic frame having a front surface, a rear surface, and peripheral wall extending between the front and rear surfaces. The peripheral wall having an inward facing surface and an outward facing surface. The inward facing surface of the peripheral wall defining a through opening into which is positionable a window assembly in sealing contact with the inward facing surface. The monolithic frame further having a sill pan flange extending continuously around the interior facing surface in a direction inwardly therefrom. The monolithic frame further having a fastening flange extending in a direction outwardly from the outward facing surface. The monolithic frame being positionable in a wall frame having a rough opening defined by a sill, a header and a pair vertical jambs extending therebetween with the peripheral wall extending into the rough opening and with the fastening flange abutting an exterior surface of the wall frame.

8 Claims, 6 Drawing Sheets

MONOLITHIC FENESTRATION CONSTRUCTION MEMBER AND WALL AND FENESTRATION ASSEMBLY USING THE SAME

FILED OF THE INVENTION

The present invention relates generally to building fenestrations, and more particularly, relating to a monolithic fenestration construction member.

BACKGROUND OF THE INVENTION

Water penetration is one of the most significant factors leading to premature failures of structures. One of the most common failure points where water enters a building's envelope is around exterior windows and doors. In conventional constructions, the ability to prevent water intrusion around window and door fenestrations is highly dependent upon the skill of the carpenter constructing the fenestration and the durability and reliability of the various materials used.

In a conventional fenestration construction, there are several separate assemblies that, if not constructed properly, will lead to failure and water intrusion. One area prone to failure, resulting in water intrusion, is the rough opening that is framed into the frame of the exterior wall into which the window is to be installed. The rough opening is essentially comprised of a header, a sill, and a pair of spaced trim studs extending vertically between the header and sill. The rough opening can be considered the base from which the remaining fenestration is built. If the rough opening is not constructed to be perfectly square (for rectangular windows) with an equal sized opening and with the correct opening dimensions for a particular window, the remaining construction becomes more difficult and more likely to fail. Another area prone to failure is the waterproof membrane that is installed around the rough opening on top of the wall's exterior sheeting, and in some applications installed over the nail fin of the window. The waterproof membrane is typically cut into long strips and is layered around the rough opening such that adjacent strips are overlapped with the vertical most layer being on top. The waterproof membrane must be carefully installed to ensure proper alignment with the rough opening and to overlay adjacent waterproof membrane layers. Another area prone to failure is the flashing that is installed along the top of the window once the window has been installed, and in some applications, the sill pan flashing that is installed along the sill of the rough opening before the window is installed.

In addition to the above, another potential problem area includes the surround trim and the sill. If the surround trim and sill is not properly sized and installed correctly, water can be directed to failure prone areas of the fenestration construction. Further, improperly sized and/or installed surround trim and sill assemblies result in a less than desirable appearance. Further, it requires a skilled carpenter to install surround trim and sills on multiple similar fenestrations while maintaining consistency between each fenestration such that each fenestration has the same visual appearance.

Accordingly, it is desirable to have a fenestration construction member which overcomes the disadvantages of the prior art, and provides increased waterproofing by integrating fenestration construction into a unitary, monolithic member that is easily installed by less skilled laborers.

SUMMARY OF THE INVENTION

The preferred embodiments of the present invention address this need by providing a fenestration construction member that is factory built and is easily installed onsite. The preferred embodiments further provide a monolithic fenestration construction member having a window assembly receiving opening into which the window assembly will fit properly with close tolerance. The preferred embodiments further provide a monolithic fenestration construction member having integrated therewith a decorative, architecturally correct, maintenance free, pre-assembled window surround trim and sill assembly. The preferred embodiments further provide a monolithic fenestration construction member which reduces the time and number of materials required to construct a fenestration. The preferred embodiments further provide a monolithic construction member that is installed and attached to the framing of a wall prior to the attachment of exterior sheeting, and thereby provides a shiplap construction increasing the waterproofing of the through wall opening. The preferred embodiments further provide a monolithic construction member where the surround trim and sill assemblies are installed prior to installation of the window assembly.

To achieve these and other advantages, in general, in one aspect, a fenestration construction member for preventing intrusion of water and air around through wall penetrations is provided. The construction member includes a monolithic frame having a front surface, a rear surface, and peripheral wall extending between the front and rear surfaces. The peripheral wall having an inward facing surface and an outward facing surface. The inward facing surface of the peripheral wall defining a through opening into which is positionable a window assembly in sealing contact with the inward facing surface. The monolithic frame further having a sill pan flange extending continuously around the interior facing surface in a direction inwardly therefrom. The monolithic frame further having a fastening flange extending in a direction outwardly from the outward facing surface. The monolithic frame being positionable in a wall frame having a rough opening defined by a sill, a header and a pair vertical jambs extending therebetween with the peripheral wall extending into the rough opening and with the fastening flange abutting an exterior surface of the wall frame.

In general, in another aspect, wall and fenestration assembly is provided. The wall and fenestration assembly includes a framed wall having an interior facing surface, an exterior facing surface, and a wall opening defined by a sill, a header and a pair vertical jambs extending between the sill and header, and exterior sheeting attached to and covering the exterior facing surface of the framed wall. The exterior sheeting having an opening corresponding to the wall opening. The assembly further includes a monolithic frame having a front surface, a rear surface, and peripheral wall extending between the front and rear surfaces. The peripheral wall having an inward facing surface and an outward facing surface. The inward facing surface of the peripheral wall defining a through opening into which is positionable a window assembly in sealing contact with the inward facing surface. The monolithic frame further having a sill pan flange extending continuously around the interior facing surface in a direction inwardly therefrom. The monolithic frame further having a fastening flange extending in a direction outwardly from the outward facing surface at an offset distance from the front surface in a direction towards the back surface. The monolithic frame further having a peripheral outward facing sealing surface between the front surface and the fastening flange. The monolithic frame is positioned with the peripheral wall extending into the wall opening, with the fastening flange fastened to the framed wall, with the exterior sheeting sandwiching the fastening flange between the exterior surface and the exterior sheeting, and with the exterior sheeting sealed against at least the sealing surface of the monolithic frame.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
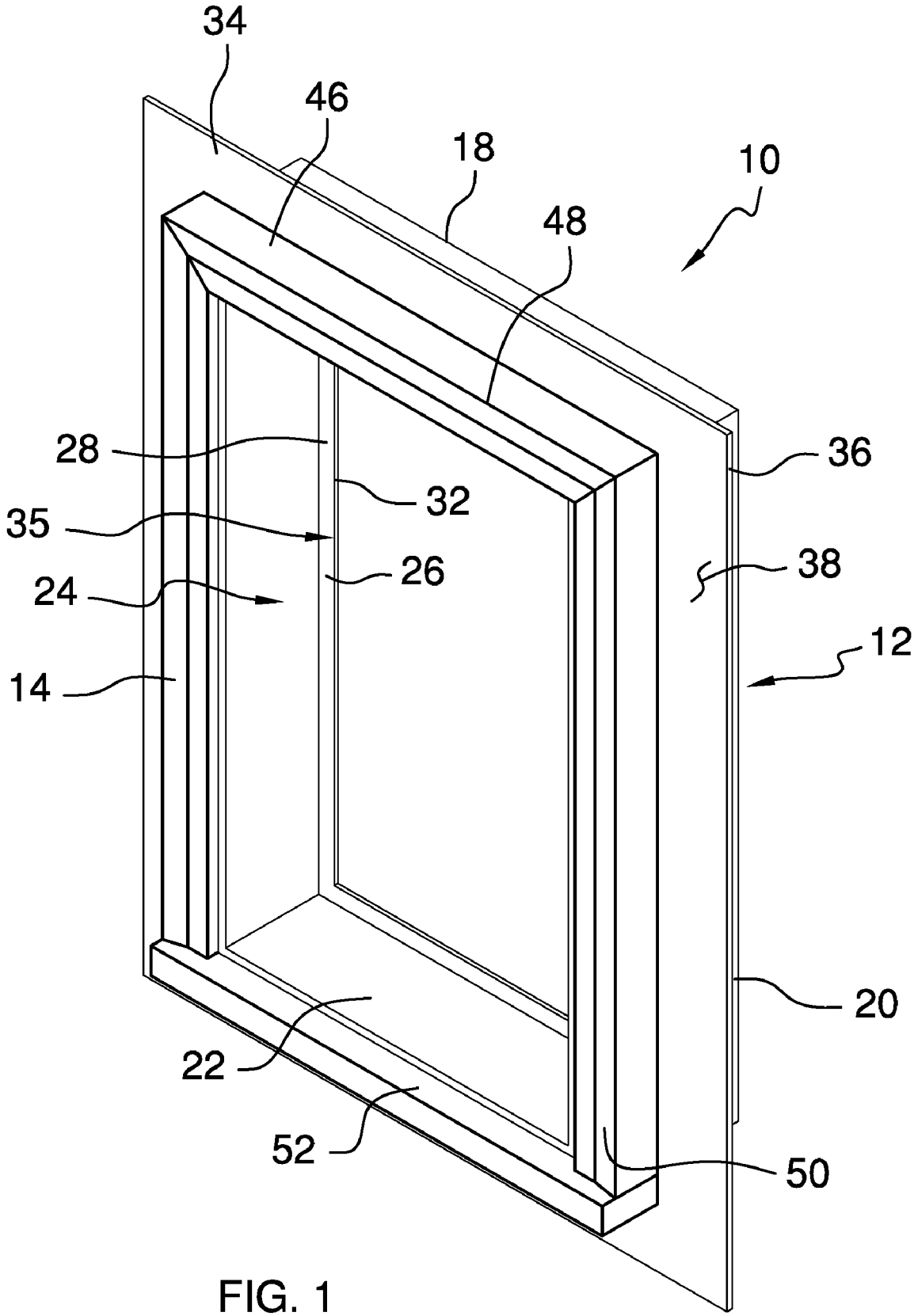
FIG. 1 is a front perspective view of a monolithic fenestration construction member in accordance with the principles of the present invention.
Figure 2:
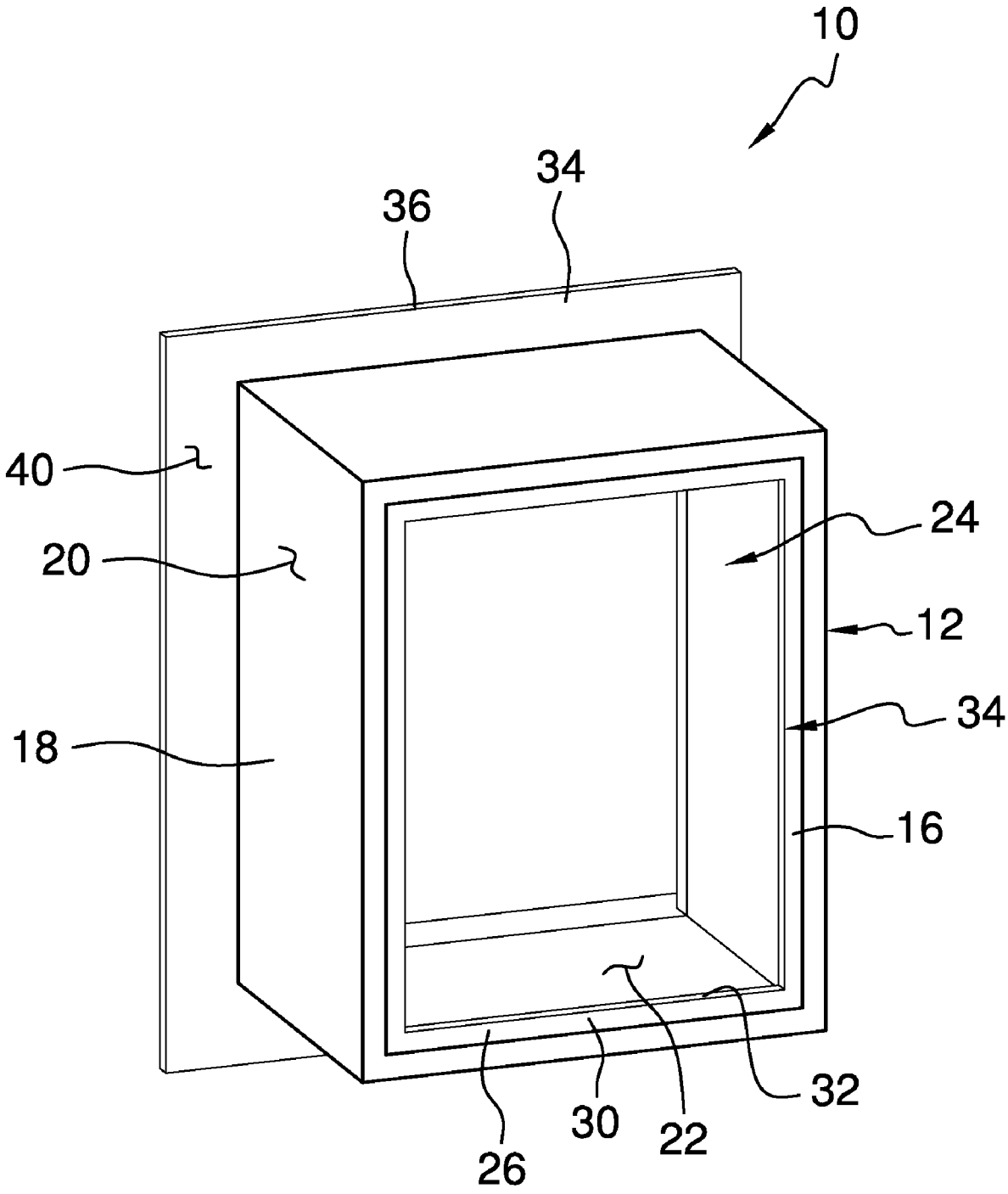
FIG. 2 is a rear perspective view of the monolithic fenestration construction member of FIG. 1.

In FIGS. 1 and 2, there is depicted a monolithic fenestration construction member 10 in accordance with the principals of the present invention, and hereinafter referred to as a construction member. FIG. 1 is a front perspective view of the construction member 10, and FIG. 2 is a rear perspective view of the construction member of FIG. 1. The intended use of the construction member 10 is in providing a factory built fenestration opening in a building where a window or door will properly fit according specified requirements, and thereby providing the highest possible sound and heat insulation attainable with the respective window or door. Further, the construction member 10 integrates into a single, monolithic member the fenestration opening, waterproofing flashing, the surround trim and the sill, which heretofore required skilled carpenters to install each separately during different phases of construction.

The construction member 10 includes a frame 12 that is molded or otherwise fabricated to be unitary and monolithic. The term monolithic, as used herein, has the meaning of formed or composed of a material without joints or seams. The frame 12 is constructed of a material non-porous to both water and air. In one aspect, the frame 12 is molded from a composite fabric sheet material bonded by a resin. The fabric sheet material can be of a fiber glass material. The frame 12 includes a front surface 14, a rear surface 16, and a peripheral wall 18 generally extending between the front and rear surfaces. The front and rear surfaces 14 and 16 are longitudinally spaced and are substantially parallel to each other. The peripheral wall 18 has an outward facing surface 20 and an oppositely-facing inward facing surface 22. The outward facing surface 20 and inward facing surface 22 are laterally spaced the thickness of the peripheral wall 18. The inward facing surface 22 defines a through opening 24, which extends longitudinally through the frame 12 from the front surface 14 to the rear surface 16.

The frame 12 further includes a sill pan flange 26. The sill pan flange 26 extends in a inwardly direction from the inward facing surface 22 continuously around the through opening 24. The sill pan flange 26 has oppositely facing sill pan flange surfaces 28 and 30, and a peripheral sill pan flange edge 32. The sill pan flange surface 28 and 30 are generally parallel to each other. The sill pan flange edge 32 defines a sill pan flange opening 35 that is narrower than the through opening 24. As shown, the sill pan flange 26 has a zero offset distance as measured from the rear surface 16 of the peripheral wall 18 with sill pan flange surface 30 flush with the rear surface. However, the sill pan flange 26 could be longitudinally offset in an inwardly direction a distance from the rear surface 16 of the peripheral wall according to desired specifications. In one aspect, the sill pan flange 26 extends from the inward facing surface 22 at a right angle thereto, and the sill pan flange edge 32 is parallel to the inward facing surface.

The through opening 24 is dimensioned to receive therein a window assembly (not shown) to be in sealing contact with the inward facing surface 22 and the sill pan flange 26 to provide a watertight and airtight installation between the through opening and the window assembly.

The frame 12 further includes a fastening flange 34. The fastening flange 34 extends in a direction outwardly from the outward facing surface 20 of the peripheral wall 18 continuously around the peripheral wall and terminates at fastening flange edge 36. The fastening flange 34 has oppositely facing fastening flange surfaces 38 and 40. In one aspect, the fastening flange 28 is planar and lies in a plane parallel to the front surface 14 of the frame 12. The fastening flange 34 serves as the attachment point between the frame 12 of the construction member 10 and the frame of the wall to which the construction member is to be used in connection with. In one aspect, the fastening flange 34 is offset a distance from the front surface 14 in a direction towards the back surface 16. The distance the fastening flange 34 is offset from the font surface 14 is at least equal to the thickness of exterior sheeting of the building wall, as will be described in further detail below.

The frame 12 can further include a peripheral sealing surface 46 located between the peripheral outward edge 48 of the front surface 14 and surface 38 of the fastening flange 34, and continuously around the peripheral outward edge 48 of the front surface 14. The sealing surface 46 is generally normal to surface 38 of the fastening flange 34, and the fastening flange edge 36 extends outwardly beyond the sealing surface 46.

In an aspect, the frame 12 can further include decorative molding which may include surround trim 50 and optionally a sill 52. The surround trim 50 and the sill 52, when provided, frame the through opening 24, and can at least partially form the front surface 14. As illustrated in FIGS. 1 and 2, The through opening 24 is rectangular shaped and includes two spaced vertical sides extending between an upper and a lower horizontal side. The surround trim 50 is provided along the two vertical sides, and the upper horizontal side, while the sill 52 is provided along the lower horizontal side. With the surround trim 50 and sill 52 molded integral and monolithic with the frame 12, there are no seams or joints that need to be sealed or flashed to prevent water or air intrusion.

Figure 3:
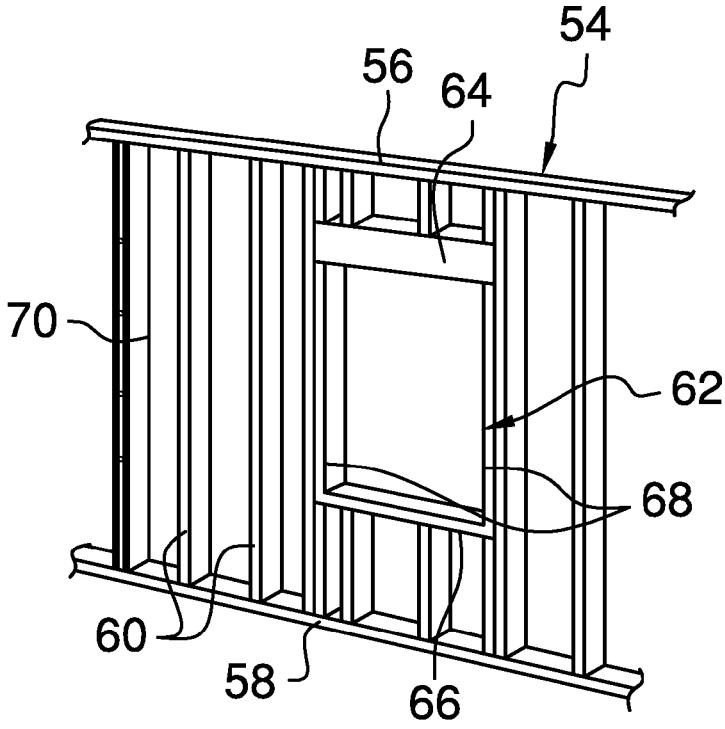
FIG. 3 is an exterior partial perspective view of a typical exterior building wall frame having a rough opening for a window.

In FIG. 3, there is illustrated a typical building exterior wall frame 54 having a top plate 56, a sole plate 58 and a plurality of spaced studs 60 extending vertically between the top plate and the sole plate. The wall frame 54 further includes a wall opening 62 for receiving a window. The rough opening 62 is defined by a header 64, a sill 66 and a pair of spaced trim studs 68 extending vertically between the header and the sill. The wall frame 54, as shown in FIG. 3, is prior to the attachment of exterior sheeting, such as ply wood, to the exterior surface 70 of the wall frame.

Figure 4:
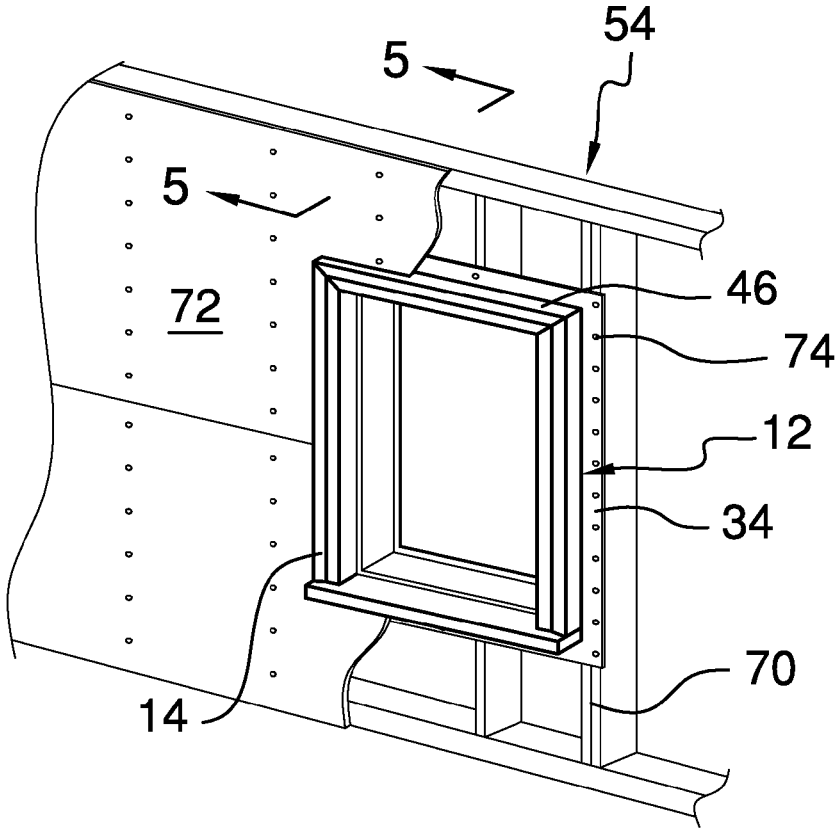
FIG. 4 is the perspective view of FIG. 3 with a fenestration construction member and exterior sheeting attached to the wall frame, and with the exterior sheeting partially removed to expose underlying portions of the fenestration construction member.
Figure 5:
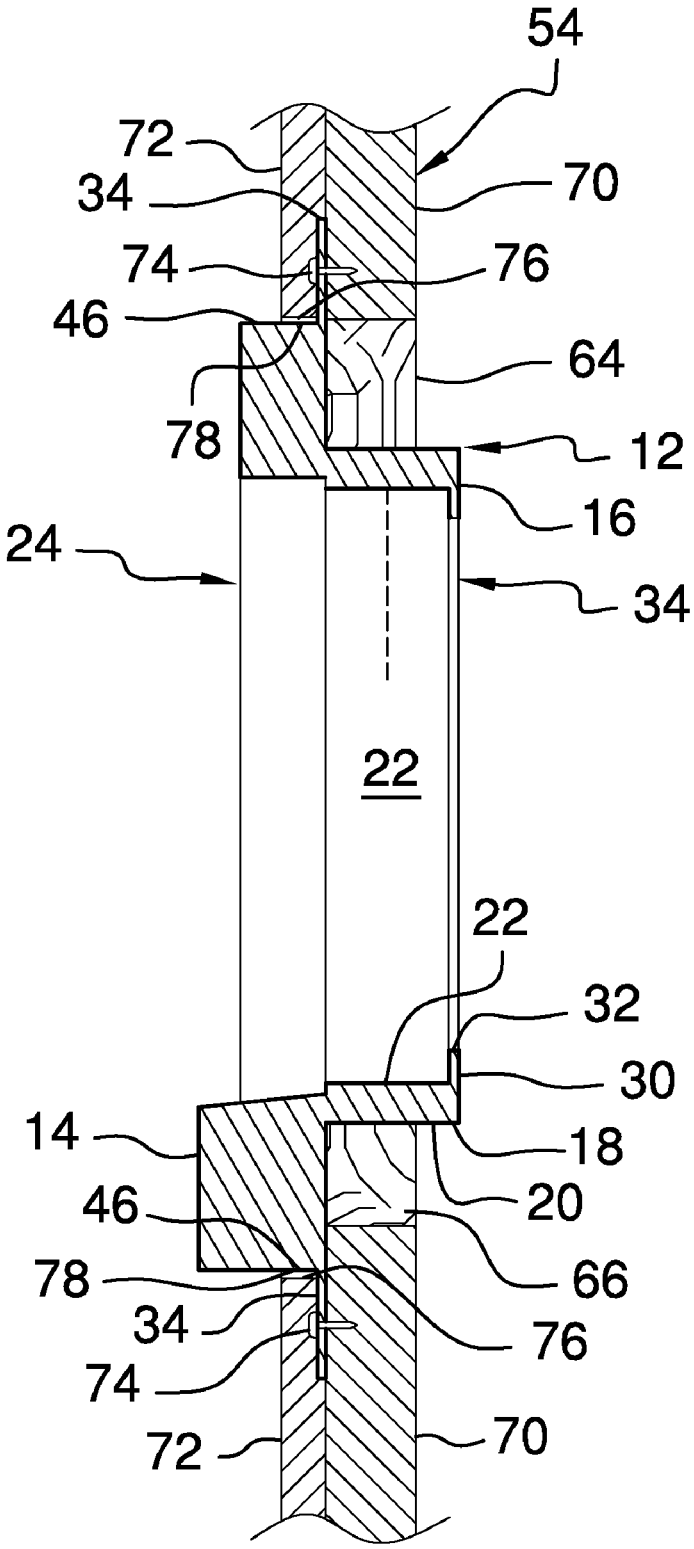
FIG. 5 is a transverse cross sectional view taken along line 5-5 in FIG. 4 through the wall, the fenestration construction member and the exterior sheeting.

In FIG. 4, there is illustrated the wall frame 54 with the construction member 10 and exterior sheeting 72. The exterior sheeting 72 is shown in partial section to illustrate portions of the underlying wall frame 54 and the frame 12 of the construction member 10. In FIG. 5, there is illustrated a transverse cross-section through the wall frame 54, construction member 10, and exterior sheeting taken along line 5-5 as depicted in FIG. 4.

With further reference to FIGS. 4 and 5, initially the peripheral wall 18 of frame 12 is inserted through the rough opening 62 with the fastening flange 34 abutted against the exterior surface 70 of the wall frame 54. The frame 12 is secured to the wall frame 54 by a plurality of penetrating fasteners 74 driven through the fastening flange 34 and into the wall frame 54. With the frame 12 secured to the wall frame 54, the front surface 14 and sealing surface 46 is spaced outwardly from the exterior surface 70 of the wall frame. Exterior sheeting 72 cut to conform to the sealing surface 46 is secured to the wall frame 54 sandwiching the fastening flange 34 between the exterior sheeting and the wall frame, with sheeting edge 76 sealed against sealing surface 46. A bead of adhesive sealant 78 can be applied to the sealing surface 46 prior to attachment of the exterior sheeting 72 to the wall frame 54 to provide a sealing contact between sheeting edge 76 and sealing surface 46. Alternatively, a bead of adhesive sealant could be applied to the interface edge between the sheeting edge 76 and the sealing surface 46 after attaching the exterior sheeting to the wall frame 54 with the sheeting edge abutted against the sealing surface.

Figure 6:
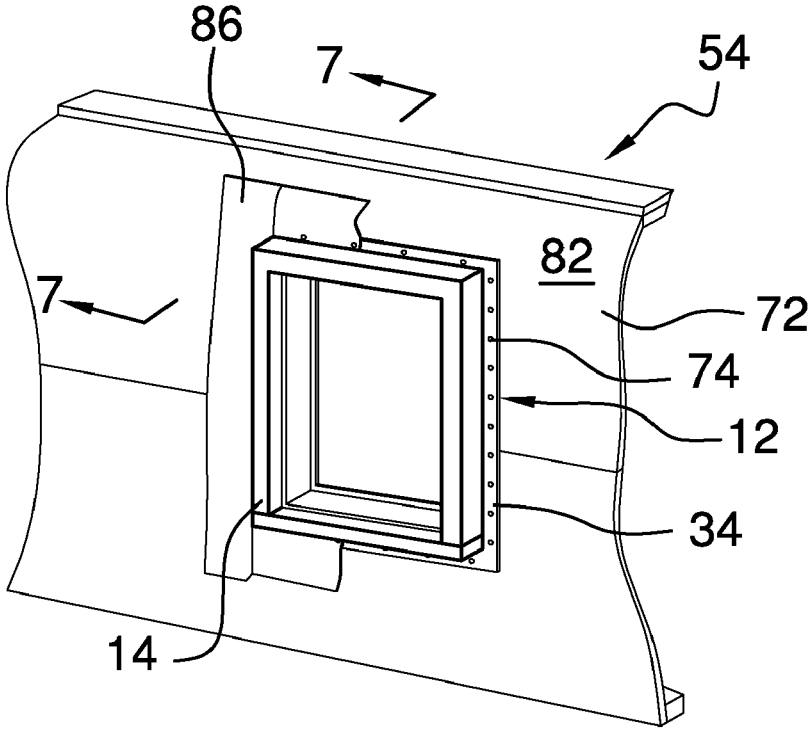
FIG. 6 is a perspective view of a fenestration construction member and wall in an alternate installed configuration.
Figure 7:
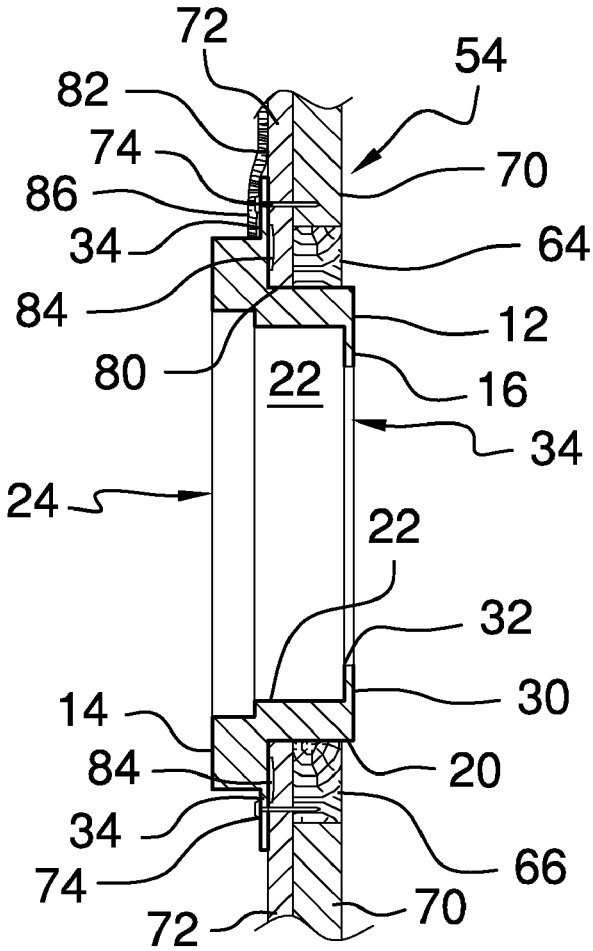
FIG. 7 is a transverse cross sectional view taken along line 7-7 in FIG. 6 through the wall and fenestration construction member.

Alternatively, with reference to FIGS. 6 and 7, the construction member 10 can be installed subsequent to the attachment of the exterior sheeting 72 to the wall frame 54. In this arrangement, the exterior sheeting 72 is initially attached to the wall frame 54 to include an opening 80 corresponding to the rough opening 62 of the wall frame. At this point, a vapor barrier could be installed on the exterior sheeting. The peripheral wall 18 of frame 12 is inserted through opening 80 and rough opening 62 with the fastening flange 34 abutted against the exterior surface 82 of the exterior sheeting 72. The frame 12 is secured to the exterior sheeting 72 and wall frame 54 by a plurality of penetrating fasteners 74 driven through the fastening flange 34 and into the exterior sheeting and wall frame. Optionally, a bead of an adhesive sealant 84 could be applied to the interface surfaces between the fastening flange and the exterior sheeting.

Once attached to the exterior sheeting 72 and wall frame 54 a vapor barrier 86 is applied to the exterior sheeting 72 and frame 12 overlapping at least the fastening flange 34 and the exterior surface 82 of the exterior sheeting. In FIG. 6, the vapor barrier 86 is partially cut-away to illustrate the fastening flange 34. The vapor barrier 86 can be of many different products used in the industry to water-proof adjoining surfaces, such as for example, adhesive flashing (peel-and-stick flashing) or liquid membrane.

Once installed, as depicted and discussed, the construction member 10 provides a wall and a fenestration assembly that is in "shiplap" fashion so that water cannot penetrate the wall about the construction member.

In an aspect, the peripheral wall 18 may extend through the rough opening 62 and beyond the interior surface of the wall frame 54 such that the back surface 16 of the frame is spaced inwardly from the wall frame. In this manner, the back surface 16 can be made to be flush with or to extend beyond interior wall finishing, such as drywall or plaster.

Figure 8:
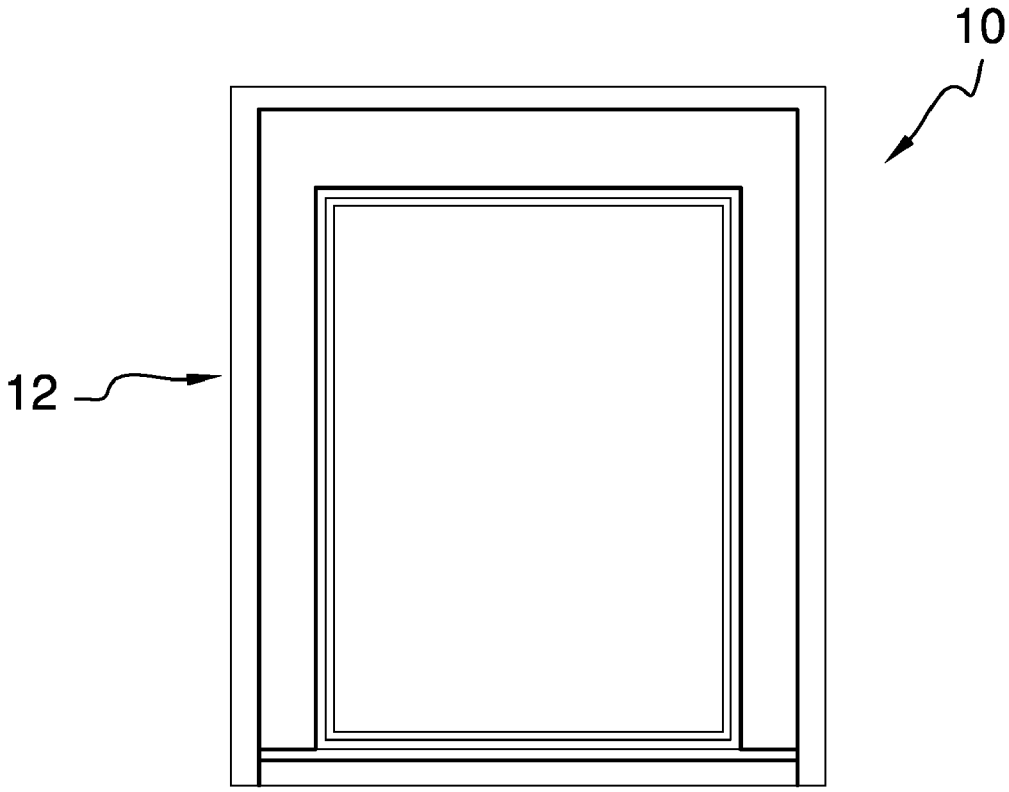
FIG. 8 is front elevation view of a fenestration construction member having an alternative surround trim and sill.
Figure 9:
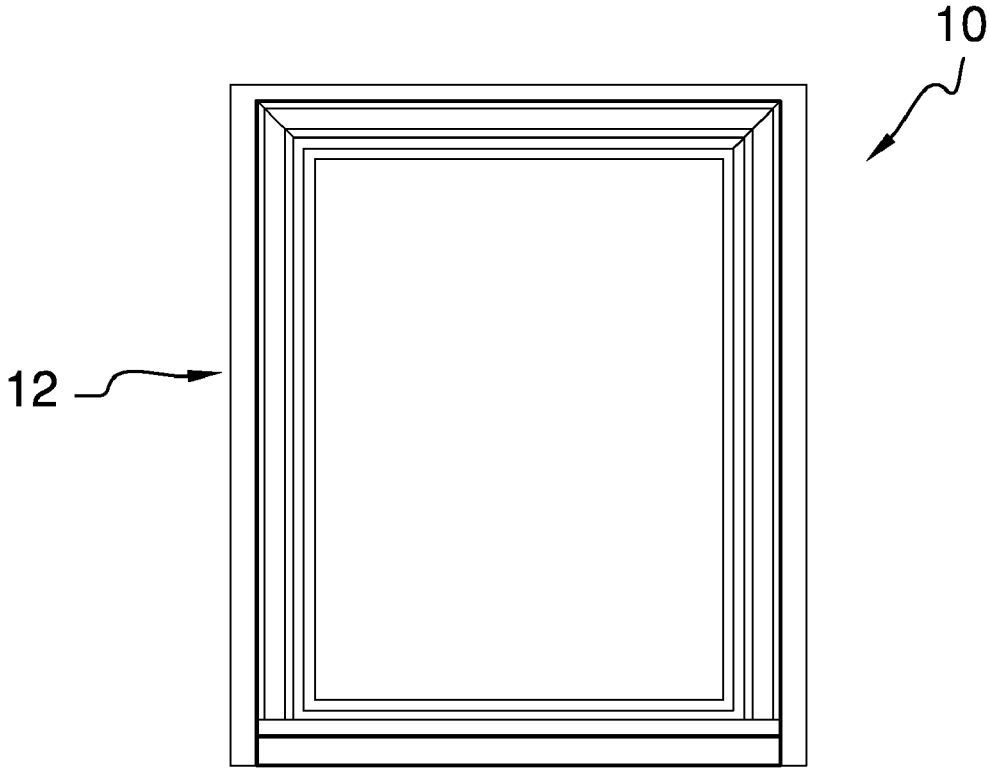
FIG. 9 is front elevation view of a fenestration construction member having an alternative surround trim and sill.

In FIGS. 8 and 9, there is depicted a construction member 10 having alternative decorative surround trim 50 and sill 52, respectively as an illustration of possible variations from the construction member depicted in FIGS. 1-7.

A number of variations are possible, for example, while the construction member as depicted and described herein includes a peripheral wall 18 and through opening being generally rectangular shaped, the through opening 24 and/or the peripheral wall 18 can take various other shapes. For example, the peripheral wall 18 could be rectangular shaped for installation in combination with wall frame having a corresponding rectangular shaped rough opening, while the through opening 24 could be circular shaped to receive a circular window assembly therein. Moreover, while the description herein is primarily directed towards window fenestrations, the construction member 10 is equally suitable for door fenestrations. Another possible variation include angling of the fastening flange 36 with respect to the front surface 14 to permit installation and attachment of the construction member to an angled wall surface while permitting a window or door to be vertically orientated. Other variations are also possible.

A number of embodiments of the present invention have been described. Nevertheless, it will be understood that various modifications may be made without departing from the spirit and scope of the invention. For example, while the description made herein is directed towards creating window openings in walls, the window buck of the present invention could easily be used to form other openings in walls, such as door openings. Accordingly, other embodiments are within the scope of the following claims.

What is claimed is:

1. A fenestration construction member for preventing intrusion of water and air around and through wall penetrations, the construction member comprising:

a monolithic frame having a front surface, a rear surface, and peripheral wall extending between said front and rear surfaces, said peripheral wall having an inward facing surface and an outward facing surface, said inward facing surface of said peripheral wall defining a through opening for receiving a window assembly in sealing contact with said inward facing surface, said peripheral wall configured for positioning within an opening through a wall with said front surface adjacent the exterior surface of the wall and with said rear surface adjacent an interior surface of the wall;

said monolithic frame further having a sill pan flange extending continuously around said inward facing surface in a direction laterally inwardly therefrom, said sill pan flange being flush with said rear surface and obstructing said through opening;

said monolithic frame further having a fastening flange extending continuously around said outward facing surface in a direction laterally outwardly therefrom at an offset distance from said front surface in a direction towards said rear surface, said fastening flange configured for engaging the exterior surface of the wall and being attached to the exterior surface of the wall; and said monolithic frame further having a decorative molding portion extending continuously around said front face about said through opening and in a direction laterally outwardly from said outward facing surface, said decorative molding not obstructing said through opening.

2. The fenestration construction member of claim 1, wherein said offset distance of said fastening flange is equal to the thickness of said decorative molding.

3. The fenestration construction member of claim 2, wherein said monolithic frame is molded from a composite material.

4. The fenestration construction member of claim 3, wherein said composite material comprises fiber glass.

5. The fenestration construction member of claim 1, wherein said decorative molding includes surround trim and a sill.

6. The fenestration construction member of claim 1, wherein said front and rear surfaces are substantially parallel to one another.

7. The fenestration construction member of claim 1, wherein said fastening flange is planar and lies in a plane parallel to said front surface.

8. The fenestration construction member of claim 1, wherein said sill pan flange includes an edge that defines a sill pan flange opening that is narrower than said through opening.

* * * * *